United States Patent [19]

Taniguchi et al.

[11] Patent Number: 4,583,836

[45] Date of Patent: Apr. 22, 1986

[54] ABNORMAL CONDITION DETECTION DEVICE FOR CORONA DISCHARGER IN ELECTROPHOTOGRAPHIC COPYING MACHINE

[75] Inventors: Akihiko Taniguchi, Kyoto; Shunju Anzai, Nara, both of Japan

[73] Assignee: Sharp Kabushiki Kaisha, Osaka, Japan

[21] Appl. No.: 570,681

[22] Filed: Jan. 13, 1984

[30] Foreign Application Priority Data

Jan. 20, 1983 [JP] Japan ..... 58-8120

[51] Int. Cl.[4] ..... G03G 15/02

[52] U.S. Cl. ..... 355/14 CH; 355/3 CH; 361/29

[58] Field of Search ..... 355/3 CH, 14 CH; 361/92, 235

[56] References Cited

U.S. PATENT DOCUMENTS 3,772,568 11/1973 Phillips ..... 361/92 X
4,272,183 6/1981 Maese et al. ..... 355/14 CH
4,398,819 8/1983 Schron ..... 355/14 CH
4,417,804 11/1983 Werner, Jr. ..... 355/14 CH
4,454,559 6/1984 Shenoy ..... 361/235 X

FOREIGN PATENT DOCUMENTS 0116360 7/1982 Japan ..... 355/14 CH

*Primary Examiner*—Fred L. Braun
*Attorney, Agent, or Firm*—Birch, Stewart, Kolasch & Birch

[57] ABSTRACT

An electrophotographic copying machine including some corona dischargers each having a high voltage transformer and an abnormal condition detection device. The abnormal condition detection device includes a detection unit for detecting an output level at a secondary winding of the transformer, an input unit for inputting an input voltage to a primary winding of the transformer. A comparator is provided for comparing the output level on the detection unit with the input level on the input unit, and outputting a detection signal. A control circuit of the copying machine is responsive to the level of the detection signal for controlling the operation of the copying machine.

4 Claims, 3 Drawing Figures

ABNORMAL CONDITION DETECTION DEVICE FOR CORONA DISCHARGER IN ELECTROPHOTOGRAPHIC COPYING MACHINE

BACKGROUND OF THE INVENTION

The present invention relates to an electrophotographic copying machine and, more particularly, to an abnormal condition detection device for a corona discharger in an electrophotographic copying machine.

An electrophotographic copying machine produces on a photoconductive layer such as a master paper an electrostatic latent image corresponding to a pattern image on a document such as a manuscript or book to be copied. Toner particles are electrostatically adhered to the latent image, so that the latent image becomes visible to form a toner image. The toner image is transferred from the photoconductive layer to a copy paper via a transference corona discharger.

A conventional transference corona discharger comprises means for causing the photoconductive layer to be charged in a specific polarity by applying a high voltage to a thin tungsten wire to cause corona charging. To apply the high voltage to the tungsten wire, a high voltage transformer is needed for receiving an AC input voltage at a primary winding and outputting an AC high voltage being N times as great as the input voltage from a secondary winding, so that the AC output is directly or, after being rectified, applied to the wire.

Recent development of semiconductor technology enables the charging high voltage transformer comprise a DC-DC converter or a DC-AC converter having a semiconductor circuit. This assists in assuring that a load current or voltage is kept constant to keep a surface level of the photoconductive layer constant even when the secondary-winding load of the discharger is unstable or the input voltage to the charging high voltage transformer is changed.

Nevertheless, since the charging wire of the corona discharger is very thin, the wire may be easily broken or short-circuited. When a plurality of corona dischargers are operated and at least one of them is damaged owing to the broken or short-circuited wire, the thus damaged corona discharger is unbalanced with the remaining dischargers, so that the surface level of the photoconductive layer is abnormally high or low. As a result, the photoconductive layer is damaged thereby reducing its copying function and shortening its operative life.

SUMMARY OF THE INVENTION

Accordingly, it is an object of the present invention to provide an improved corona discharger for an electrophotographic copying machine.

It is another object of the present invention to provide an improved abnormal condition detection device of a corona discharger for an electrophotographic copying machine.

It is a further object of the present invention to provide an improved abnormal condition detection device of a corona discharger for stopping the operation of an electrophotographic copying machine upon detecting an abnormal condition.

Briefly described, in accordance with the present invention, an electrophotographic copying machine comprises a plurality of corona dischargers each including a high voltage transformer and an abnormal condition detection device. The abnormal condition detection device comprises a receiving unit, an input unit, and a comparison unit. The receiving unit receives an output at a secondary winding of the transformer. The input unit receives an input voltage to a primary winding of the transformer. The comparison unit is provided for comparing the level of the receiving unit with the level of the input unit, and providing an output signal whose level indicates the comparison result. Responsive to the level of the output signal, a control circuit of the copying machine controls operation of the copying machine.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
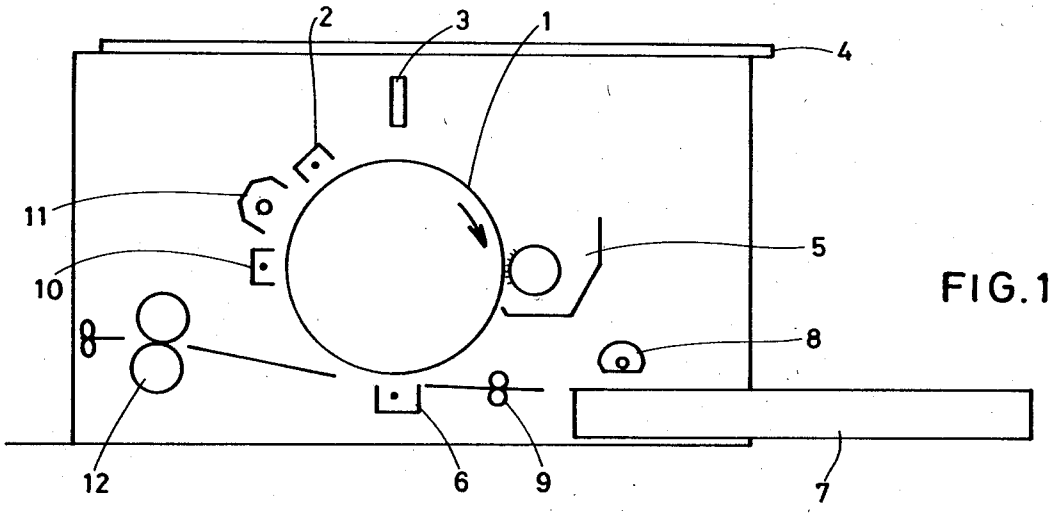
FIG. 1 is a cross-sectional view of an electrophotographic copying machine for use in the present invention.

FIG. 1 shows an electrophotographic copying machine for use in the present invention. The copying machine comprises a photoconductive layer 1, a corona discharger 2, an optical lens array 3, a document table 4, a developer and cleaning device 5, a transfer corona discharger 6, a paper cassette 7, some paper pick-up rollers 8, a pair of paper feed rollers 9, a charge removing corona discharger 10, a charge removing lighting device 11, and a pair of heat fixing rollers 12.

The photoconductive layer 1 is disposed around a drum which is rotated in the arrow direction. The corona discharger 2 is operated to charge the photoconductive layer 1 in a specific polarity. The optical lens array 3 is used to let an image on a document mounted on the table 4 incident upon and focused on the surface of the photoconductive layer 1 to form a latent image corresponding to the image on the document. The developer and cleaning device 5 is operated to develop the latent image with toner particles and remove the remaining toner particles from the photoconductive layer 1. The paper cassette 7 stores a great number of plain papers. The paper pick-up rollers 8 are rotated to pick up a sheet of plain paper from the paper cassette 7. The rollers 9 are rotated to transport the pick-up paper. The transfer corona discharger 6 discharges to transfer the toner image on the photoconductive layer 1 onto the paper. The charge removing corona discharger 10 discharges to remove the remaining charges on the surface of the photoconductive layer 1 after the corona transfer. The charge removing lighting device 11 causes the remaining charges on the surface of the photoconductive layer 1 to be charged and removed. The copied paper is separated from the photoconductive layer 1 with a separation means. The heat fixing rollers 12 are rotated to fix the toner image onto the surface of the copied paper with heating.

While, preferably, the photoconductive layer 1 is charged at a negative polarity, the image on the document is incident upon and exposed to the layer 1 with the optical lens array 3 to form the latent image onto the layer 1. The latent image becomes visible as the toner image during subsequent developing steps with the developer 5. Because the transfer corona discharger 6 provides a corona discharge of a negative polarity to charge the copy paper in a negative polarity, the toner image is electrostatically attracted by the copy paper to transfer the toner image. After the corona transfer, the copied paper carrying the transferred toner image is separated from the layer 1 and is transported toward the fixing rollers 12 by which the toner image is fixed onto the copied paper to thereby exhaust the copied paper outside the copying machine.

After the corona transfer, the layer 1 is rotated so as to confront the charge removing corona discharger 10 and the charge removing lighting device 11, so that the layer 1 is subjected to discharging by the discharger 10 and lighting by the device 11, whereby the surface level of the layer 1 is returned at a constant level, for example, 0 volt. The cleaning device 5 is operated to remove the remaining toner particles on the layer 1 to clean it. The corona discharger 10 provides a corona discharge of the positive polarity to remove the remaining charges of a negative polarity on the layer 1. Since the remaining toner particles on the layer 1 are charged at a positive polarity by the corona discharger 10, it is easy for the cleaning device 5 to clean the surface of the layer 1.

Figure 2:
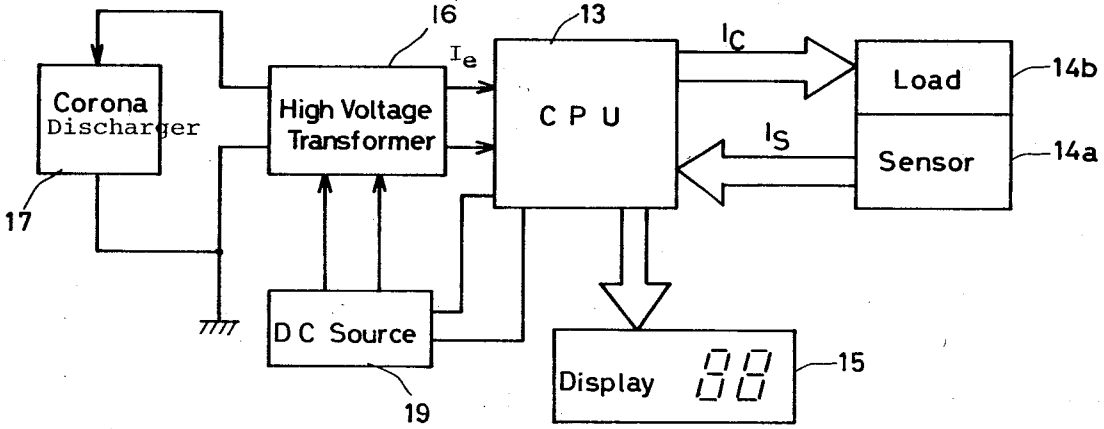
FIG. 2 is a block diagram of a control circuit implemented within the machine.

FIG. 2 shows a block diagram of control circuit implemented within the copying machine of FIG. 1. The control circuit of FIG. 2 operates the above described copying steps.

The control circuit comprises a central processing unit (CPU) 13, a sensor 14*a*, a load 14*b*, a display 15, a high voltage transformer 16, a corona discharger 17, and a DC source 19.

The sensor 14*a* is provided for detecting the revolution position of the layer 1 and the moving position of the document table 4 to output a detection signal Is. The CPU 13 is responsive to the signal Is for outputting a control signal Ic into the load 14*b* of each of the document table 4, the corona discharger 6, and the developing and cleaning device 5 and the others to activate them. Thus, the copying operation is carried out sequentially. Further, the CPU 13 activates the display 15 to display the number of copy set papers and the number of copied papers.

According to the present invention, when any abnormal condition occurs in the corona discharger 17 for activating each of the corona discharger 2, the transfer corona discharger 6, or the charge removing corona discharger 10 and the like, the corona discharger 17 provides an abnormal signal Ie. The CPU 13 is responsive to the signal Ie for promptly stopping the operation of the copying machine so that the display 15 is caused to display which corona discharger from the corona dischargers 2, 6 and 10 is abnormal.

Figure 3:
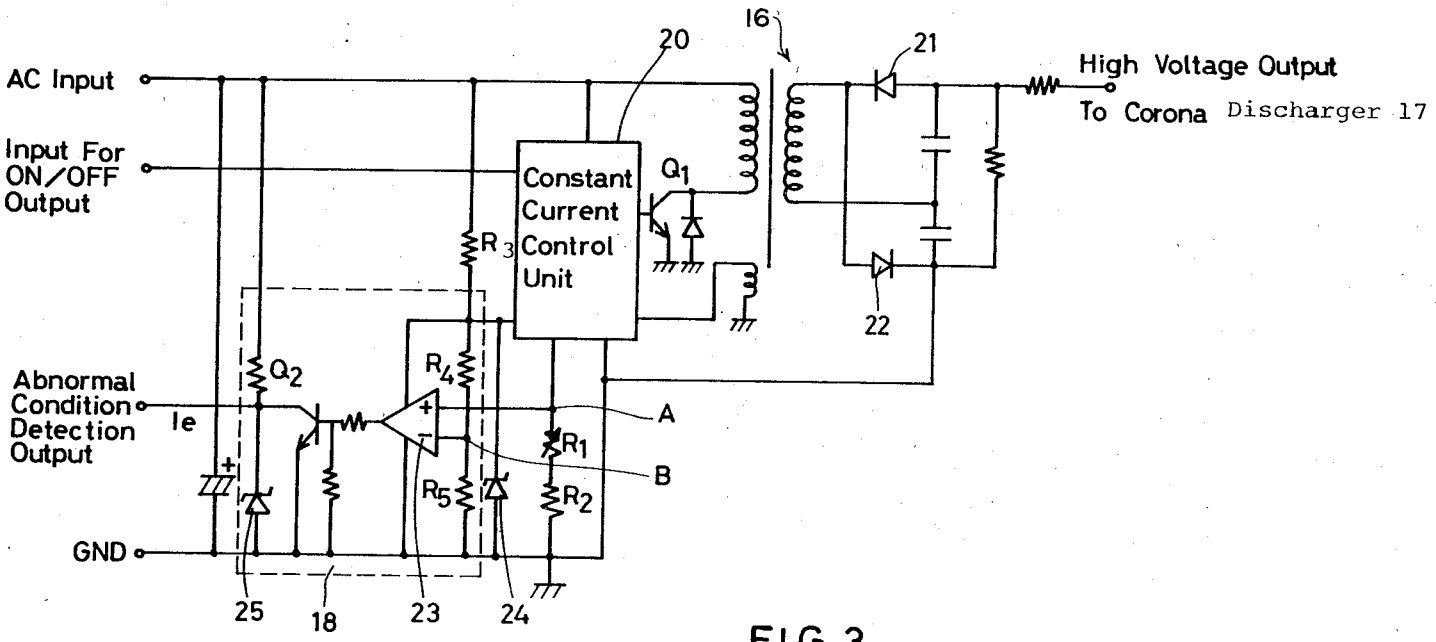
FIG. 3 is a configuration of a corona discharger circuit comprising a high voltage transformer and an abnormal condition detection device according to the present invention.

FIG. 3 shows a circuit of a high voltage transformer including an abnormal condition detection circuit 18 connected to a proper high voltage transformer.

The high voltage transformer 16 supplies a DC voltage from the DC source 19 into a primary winding and, in addition, to a constant current control unit 20. The constant current control unit 20 is operated to flow a constant current into the primary winding regardless of whether or not the input voltage is changed. Further, the constant current control unit 20 is responsive to an ON signal appearing on a terminal of "INPUT FOR ON/OFF OUTPUT" for outputting a signal into the base of a transistor Q1, so that the transistor Q1 is switched on or off, whereby an AC high voltage, for example, of 7 KV and a frequency identical with the switching frequency of the transistor Q1 is generated at the secondary winding.

The AC output on the secondary winding is rectified at full waves by rectifiers 21 and 22, so that the resultant DC voltage of a negative polarity is applied to the wire of the corona discharger 17.

A feedback current from the high voltage output at the secondary winding flows across resistances R1 and R2 to convert the feedback current into a voltage, so that the converted voltage is applied to a positive terminal of a comparator 23 in the abnormal condition detection circuit 18. To a minus terminal of the comparator 23, a fixed reference voltage is applied whose level is selected to be lower than the level of a load current to the corona discharger 17 at the normal condition. The voltage across a resistance R5 is applied to the minus terminal of the comparator 23. The DC voltage through a resistance R3 is divided by resistances R4 and R5. To prevent the voltage of the resistance R5 from being varied in response to the input voltage, a zener diode 24 is connected in parallel with the resistances R4 and R5. By connecting the resistance R4 and R5 to the minus terminal of the comparator 23, a voltage is applied which is lower than a voltage detected with a load current at the condition wherein the corona discharger 17 is normal. Therefore, if the corona discharger 17 is normal so that the load current to the corona discharger 17 is normal, the positive terminal of the comparator 23 receives an input voltage higher than at the minus terminal thereof, so that the comparator 23 outputs a high voltage "H". When the high voltage output is lower than a predetermined level, the constant current control unit 20 limits the load current. That is, when a short-circuiting occurs, the output voltage nears 0 v., so that the unit 20 limits the current to prevent overcurrent.

The output of the comparator 23 is applied to the base of a transistor Q2 through a resistance. To the collector of the transistor Q2, a DC current is applied through a resistance to provide the abnormal condition detection output signal Ie. A zener diode 25 is connected between the emitter and the collector of the transistor Q2 to make the level of the output signal Ie constant.

When the corona discharger 17 is abnormal, the following operation is conducted:

(1) When the output load is broken to thereby make the circuit open: In this case, no discharging current of the high voltage is generated, so that the voltage at point A due to the feedback current is about 0 v. Therefore, since the voltage at the point A is lower than the reference voltage at point B connected to the minus terminal of the comparator 23, the output of the comparator 23 is changed to be on a low level "L". Responsive to the low level output of the comparator 23, the transistor Q2 is nonconductive, so that the level of the output signal Ie is changed to be the high level "H".

In addition to detection of the broken wire in the corona discharger 17, such an operation is also carried out when no high voltage is applied to the wire.

(2) When the output load is short-circuited: When the output voltage is lower than, for example, 2 KV, the constant current control unit 20 limits the load current. Hence, the load feedback current is limited, so that the voltage at point A is lower than the reference voltage at point B. Therefore, the output of the comparator 23 is changed to be on the low level "L" and the abnormal condition detection output signal Ie is changed to be on the high level "H".

Thus, whenever the corona discharger 17 is short-circuited or opened, the output signal Ie is changed to be on the high level "H". Since the output signal Ie is applied to the CPU 13, the CPU 13 is responsive to the high level "H" of the output signal Ie for detecting which corona discharger among the corona dischargers 2, 6 and 10 is abnormal and causing the display 15 to display an indicia of the abnormal corona discharger. For this purpose, the abnormal condition detection unit 18 is connected to a discharging transformer of each of the corona dischargers 2, 6 and 10. Thus, the CPU 13 provides a self-diagnosis function as to which corona discharger is abnormal. Responsive to the receipt of the output signal Ie on the high level "H", the CPU 13 promptly terminates the operation of the copying machine so that the surface voltage level of the photoconductive layer 1 is varied.

Thus, the abnormal condition detection device of the corona discharger according to the present invention is featured in that the load current of the corona discharger is detected to determine the generation of the abnormal condition, so that, in response to the abnormal detection signal, the copying machine stops copying. The photoconductive layer is prevented from being damaged to thereby prolong the life of the photocopying machine.

While only certain embodiments of the present invention have been described it will be apparent to those skilled in the art that various changes and modifications may be made therein without departing from the spirit and scope of the present invention as claimed.

What is claimed is:

1. A device for detecting an abnormal condition in a corona discharger of an electrophotographic copying machine, said corona discharger including a corona electrode spaced from a photoconductive surface, and a transformer with a primary winding and a secondary winding coupled to the corona electrode for applying a charging voltage thereto, said device comprising:

(a) comparator means having first and second input terminals;

(b) means for applying a reference voltage from said primary winding of said transformer to the first input terminal of the comparator means;

(c) resistor means in circuit with the second input terminal of said comparator means for converting currents passing through the resistor means to a control voltage at the second input terminal;

(d) means for applying a feedback current from the secondary winding of said transformer through said resistor means, said feedback current creating a control voltage higher than said reference voltage during normal operating conditions of the corona electrode, said feedback current becoming essentially zero when an open circuit is formed between the corona electrode and ground, thus providing a control voltage of essentially zero at the second input terminal of said comparator;

(e) constant current control means in circuit with both said secondary winding and said resistor means for applying a constant current through said resistor means of a limited value which will create a control voltage which is less than said reference voltage, said constant current control means generating a current of said limited value responsive to a low charging voltage output by the secondary winding on said corona electrode, said low charging voltage being of a value indicative of a short circuit between the corona electrode and ground; and (f) means for generating an abnormal condition signal indicative of either a short or open circuit between said corona electrode and ground whenever the control voltage at the second input of the comparator means is less than the reference voltage at the first input of the comparator means.

2. The device of claim 1, futher including display means responsive to the abnormal condition signal providing a visual indication of the abnormal condition.

3. A system for detecting abnormal conditions in a plurality of corona dischargers of an electrophotocopying machine and determining which corona discharger has an abnormal condition associated therewith, each said corona discharger including a corona electrode spaced from a photoconductive surface, a transformer with a primary winding and a secondary winding coupled to the corona electrode for applying a charging voltage thereto, said device comprising:

(a) a detection device for each corona discharger including, 1. comparator means having first and second input terminals,
2. means for applying a reference voltage from said primary winding of said transformer to the first input terminal of the comparator means,
3. resistor means in circuit with the second input terminal of said comparator means for converting currents passing through the resistor means to a control voltage at the second input terminal,
4. means for applying a feedback current from the secondary winding of said transformer through said resistor means, said feedback current creating a control voltage higher than said reference voltage during normal operating conditions of the corona electrode, said feedback current becoming essentially zero when an open circuit is formed between the corona electrode and ground, thus providing a control voltage of essentially zero at the second input terminal of said comparator,
5. constant current control means in circuit with both said secondary winding and said resistor means for applying a constant current through said resistor means of a limited value which will create a control voltage which is less than said reference voltage, said constant current control means generating a current of said limited value responsive to a low charging voltage output by the secondary winding on said corona electrode, said low charging voltage being of a value indicative of a short circuit between the corona electrode and ground; and
6. means for generating an abnormal condition signal indicative of either a short or open circuit between said corona electrode and ground whenever the control voltage at the second input of the comparator means is less than the reference voltage at the first input of the comparator means; and (b) means for determining which of said detection devices generates an abnormal condition signal.

4. The system of claim 3, wherein said means for determining includes display means for visually displaying which corona discharger is experiencing an abnormal condition.

* * * * *